United States Patent [19]

Pollock

[11] Patent Number: 4,741,276

[45] Date of Patent: May 3, 1988

[54] FIRE RESISTANT CABINET

[75] Inventor: James F. Pollock, Old Windsor, England

[73] Assignee: United Kingdom Atomic Energy Authority, London, England

[21] Appl. No.: 912,234

[22] Filed: Sep. 29, 1986

[30] Foreign Application Priority Data

Oct. 10, 1985 [GB] United Kingdom ..... 8524975

[51] Int. Cl.[4] ..... E04F 5/00

[52] U.S. Cl. ..... 109/65; 109/82

[58] Field of Search ..... 109/65, 84, 82, 49.5, 109/2, 59, 75

[56] References Cited

U.S. PATENT DOCUMENTS

| | | | |
|---|---|---|---|
| 1,485,360 | 3/1924 | Bartels . | |
| 1,546,403 | 7/1925 | Raven . | |
| 1,623,155 | 4/1927 | Bellamore | 109/65 |
| 2,492,422 | 12/1949 | Govan | 109/84 |
| 3,709,169 | 1/1973 | Gauger . | |
| 4,373,450 | 2/1983 | Miller . | |
| 4,422,386 | 12/1983 | Carpenter . | |
| 4,574,454 | 3/1986 | Dyson | 109/84 |
| 4,628,826 | 12/1986 | Richter | 109/82 |

FOREIGN PATENT DOCUMENTS

| | | | |
|---|---|---|---|
| 0023621 | 7/1980 | European Pat. Off. . | |
| 0102570 | 3/1984 | European Pat. Off. . | |
| 385162 | 2/1908 | France . | |
| 2492447 | 4/1982 | France . | |
| 7502691 | 9/1975 | Netherlands | 109/84 |
| WO84/00783 | 3/1984 | PCT Int'l Appl. . | |
| WO85/01079 | 3/1985 | PCT Int'l Appl. . | |
| 1302839 | 1/1973 | United Kingdom . | |
| 1302843 | 1/1973 | United Kingdom . | |
| 1321984 | 7/1973 | United Kingdom . | |
| 1321985 | 7/1973 | United Kingdom . | |
| 1356109 | 6/1974 | United Kingdom . | |
| 1498117 | 1/1978 | United Kingdom . | |
| 2118370 | 10/1983 | United Kingdom . | |

*Primary Examiner*—Robert L. Wolfe

*Attorney, Agent, or Firm*—William R. Hinds

[57] ABSTRACT

A panel, which may form a wall or a door (12) of a fire resistant cabinet (10), consists of an outer casing (16, 26) and an inner panel (14, 24) spaced apart by zig-zag shaped bridging members (20, 22, 28). The inner panel is double-walled and contains a material which undergoes a phase change at a temperature below that at which the contents of the cabinet might suffer damage. The space between the outer casing and the inner panel contains a number of metal foils (32, 34) parallel to the outer casing which acts as radiant heat shields. The bridging members may be of ceramic material of low thermal conductivity, and may be slotted to increase their resistance to heat flow.

4 Claims, 2 Drawing Sheets

FIRE RESISTANT CABINET

This invention relates to panels for fire resistant rooms or fire resistant cabinets.

It is desirable that fire resistant rooms and cabinets should be able to protect their contents while being exposed externally to a temperature of possibly over 1000° C. for over an hour. Furthermore if a building is on fire, any such cabinet may also undergo impacts for example from falling itself or from objects falling onto it. If the cabinet or room is used to store paper, the contents should preferably be kept below about 170° C., while if the contents are magnetic storage media such as tapes or disks they should preferably be kept below about 60° C.

It is known to make insulating panels for fire resistant rooms and cabinets incorporating a layer of a cement-based material. When exposed to heat, water which is mechanically and chemically bound in the cement-based material evaporates and provides an endothermic effect. However the use of such material leads to a very heavy panel.

According to the present invention there is provided a fire resistant cabinet for maintaining its contents below a predetermined temperature comprising, an inner container at least partly of double-walled construction, a material located within the walls of the inner container and which undergoes a phase change requiring latent heat below the predetermined temperature; an outer casing surrounding and spaced apart from the inner container; a thermal insulation layer between the outer casing and the inner container comprising a plurality of spaced apart, low thermal emissivity, heat shields each being parallel to the adjacent wall of the outer casing; and at least six bridge members connecting the inner container and the outer casing, each bridge member being of zig-zag shape and defining a plurality of slots extending generally parallel to the crests of the zig-zag, the bridge members supporting the inner container relative to the outer casing even if the cabinet is subjected to an impact.

The inner container may be substantially filled by the phase change material, which may for example be hydrated sodium metasilicate ($Na_2SiO_3.9H_2O$) which melts at about 48° C.

The heat shields may comprise metal foil such as steel foil of thickness 0.03 mm, and may be coated with a low thermal emissivity coating such as nickel or chromium, for which the emissivity is less than 0.2. The number of heat shields may be between three and ten, preferably about five. The bridge member may be used to support the heat shields in their spaced-apart positions. Adjacent slots in the bridge member are desirably in staggered relationship. The bridge member may be of metal such as stainless steel, or of a ceramic.

It has been found that the cabinets of the invention can resist fires as effectively or better than those of the prior art, and are significantly lighter in weight.

The invention will now be further described by way of example only and with reference to the accompanying drawings, in which.

Figure 1:
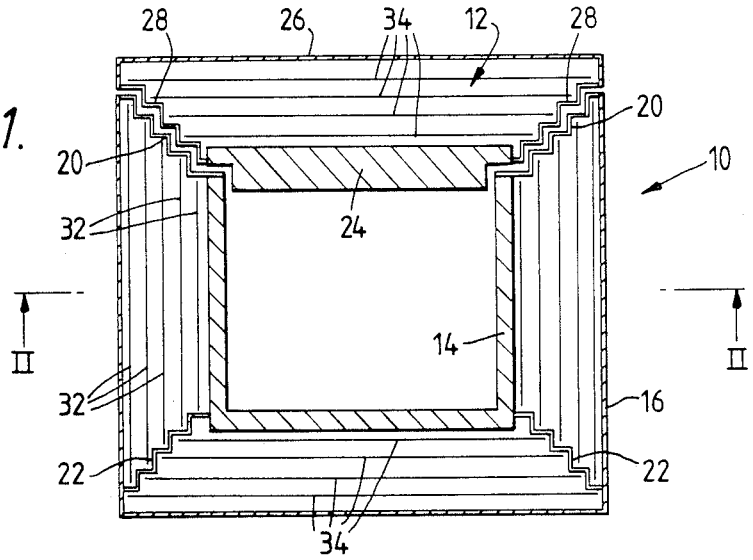
FIG. 1 shows a cross-sectional view of a fire-resistant cabinet.

Referring to FIG. 1, a fire resistant cabinet 10 is of rectangular shape, one wall of the cabinet 10 being defined by a door 12 which is shown slightly open. The cabinet 10 includes an inner container 14 of sheet steel which is of double-walled construction, the space between its walls being about 15 mm thick and being filled with hydrated sodium metasilicate; and an outer casing 16 also of sheet steel. The inner container 14 is supported within the outer casing 16, and spaced apart from it, by zig-zag shaped bridge members 20,22 (to be described in greater detail later) which run parallel to the edges of the inner container 14 and extend from near the edges of the inner container 14 to near the edges of the outer casing 16; the bridge members 20 run along the four front edges around the opening for the door 12, and the bridge members 22 run along near the four rear edges of the cabinet 10. The door 12 is of similar structure to the other walls of the cabinet 10, having an inner panel 24 of sheet steel of double walled construction filled with hydrated sodium metasilicate; and an outer casing 26 also of sheet steel. The inner panel 24 is joined to, and spaced apart from, the outer casing 26 by zig-zag shaped bridge members 28 which run along all four edges of the door 12. The front bridge-members 20 and the door bridge members 28 are of the same cross-section, so that the door 12 mates with the opening defined by the front bridge members 20.

Figure 2:
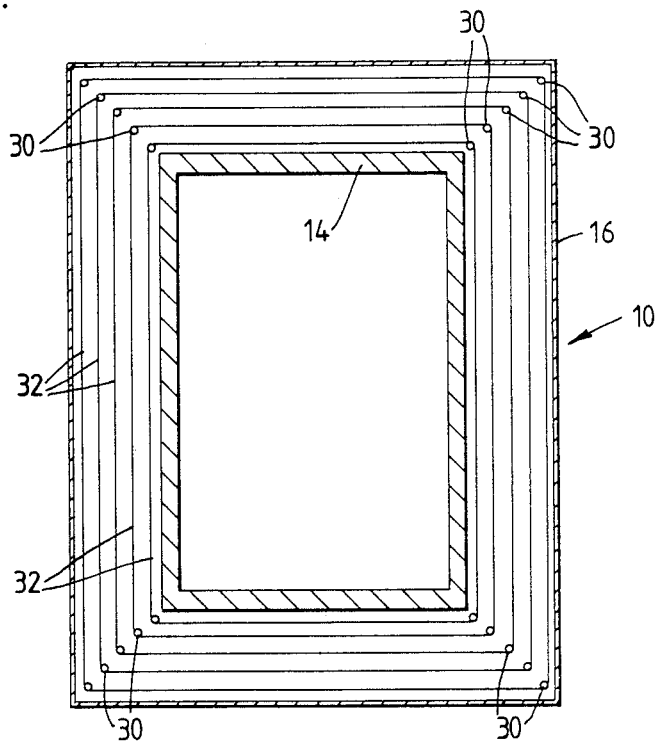
FIG. 2 shows a sectional view on the line II—II of FIG. 1.

Referring also to FIG. 2, five thin-walled stainless steel tubes 30 extend parallel to each side edge of the cabinet 10, in the space between the edges of the inner container 14 and the outer casing 16, supported at their ends by the front and rear bridge members 20 and 22. Five radiation shields 32 are supported by these tubes 30. Each radiation shield 32 consists of a continuous belt of 0.03 mm thick mild steel foil coated with electroless nickel, surrounding the sides, top and bottom of the inner container 14 and passing round one of the tubes 30 at each edge. The radiation shields 32 are spaced from one another about 6 mm apart; and as shown in FIG. 1 each is of width approximately equal to the corresponding distance between the front and rear bridge members 20 and 22, so that the gaps between the front and the rear bridge members 20 and 22 and the edges of each radiation shield 32 are very narrow.

Referring again to FIG. 1, four radiation shields 34 are provided within the rear wall of the cabinet 10, each attached to and supported by thin-walled stainless steel tubes (not shown) along its top and bottom edges, these tubes extending between the rear bridge members 22. A further four radiation shields 34 are provided within the door 12 of the cabinet 10, each attached to and supported by thin-walled stainless steel tubes (not shown) along its top and bottom edges, these tubes extending between the door bridge members 28. The radiation shields 34 are rectangular sheets of 0.03 mm thick mild steel foil coated with electroless nickel.

Additional heat shields (not shown) are provided at each of the eight external corners of the cabinet 10, each comprising a piece of nickel-plated thin steel foil spaced apart from the corner within the outer casing 16 or 26, and being joined to the outer casing 16 or 26 away from the corner.

Figure 3:
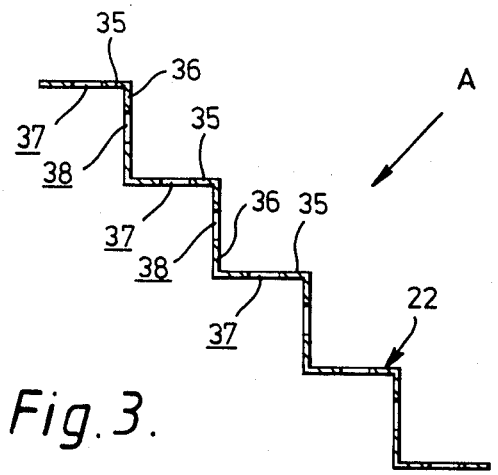
FIG. 3 shows an enlarged view of a bridge member 22 of FIG. 1.
Figure 4:
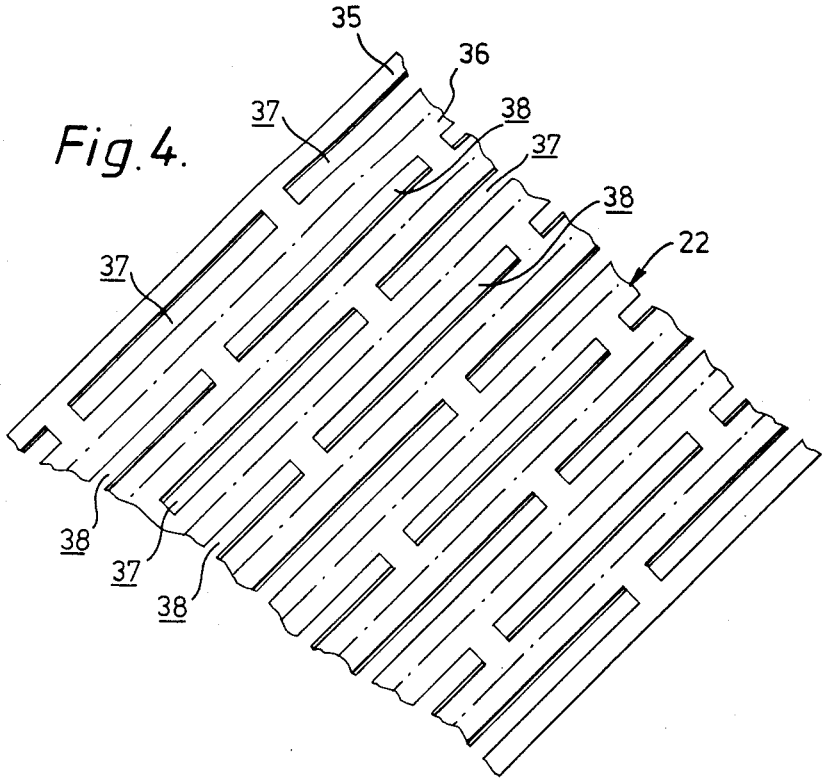
FIG. 4 shows a view in the direction of arrow A of FIG. 3.

The door bridge members 28, the front bridge members 20 and the rear bridge members 22 are all of the same form, being of the same low thermal conductivity ceramic material, of thickness 5 mm, and being of the same zig-zag shape. FIGS. 3 and 4, to which reference is now made, show one of the rear bridge members 22 to a larger scale than in FIG. 1. Each tread 35 or riser 36 of the zig-zag is of the same width, oriented at right angles to each other. Row of slots 37 and slots 38 are defined in the treads 35 and the risers 36 respectively, each slot 37 or 38 being of length 45 mm and being separated from the next slot 37 or 38 in the row by a distance of about 5 mm. The slots 37 in the treads 35 are staggered in relation to the slots 38 in the risers 36. All the surfaces of the bridge member 22 are coated with nickel to reduce heat transfer by radiation across the slots 37 or 38, or between adjacent treads 35 and risers 36.

The slotted bridge members 20, 22 or 28 are sufficiently strong to support the inner container 14 or the inner panel 24 spaced apart from the outer casing 16 or 26 respectively, even under impact conditions, but provide a very poor path for conduction of heat between the outer casing 16 or 26 and the inner container 14 or the inner panel 24. The zig-zag shape increases the effective path length over which heat transfer is to occur, while the staggered slots 37 and 38 further increase the path length and also introduce reductions in the cross-sectional area available for heat transfer.

Thus if the cabinet 10 is exposed to a fire, at possibly 1,000° C., heat transfer through the walls and the door 12 is principally by radiation which is minimised by the radiation shields 32 and 34. Heat transfer through the bridge members 20, 22, 28 by conduction is minimised by their zig-zag shape and by the slots 37 and 38. The contents of the cabinet 10 will not rise in temperature above 50° C. until sufficient heat has reached the inner container 14 and the inner panel 24 that all the hydrated sodium metasilicate has melted, which requires latent heat, and hence the time for which the contents are protected is determined by the thickness of the hydrated sodium metasilicate layer. It will be appreciated that the inner container 14 and the inner panel 24 may be of greater thickness in the vicinity of the corners or the edges of the cabinet 10, where the heat flux is greater.

It will be appreciated that the number of radiation shields 32 and 34 in the walls and the door 12 of the cabinet 10 may be different from that described above, and the low emissivity surface may be provided by a different coating, for example of electroless chromium. The number of treads 35 (or risers 36) in each bridge member 20, 22 and 28 is preferably about the same as the number of radiation shields 32 or 34, and so may differ from that shown in the drawings. The slots 37 and 38 may differ in length from that described above; in alternative embodiments (not shown) slots 37 may be provided in the treads 35, the risers 36 being unslotted, or both treads 35 and risers 36 may be unslotted. Furthermore the bridge members 20, 22, 28 might be of a metal such as stainless steel, rather than a ceramic; in this case the material is desirably thinner (for example 1 mm instead of 5 mm) as the thermal conductivity of stainless steel is about twenty times greater than that of a ceramic.

Furthermore each wall might incorporate one or more sheets of microporous insulation (comprising silica aerogel and an opacifier, and as sold under the trade mark "Microtherm") between the radiation shields 32, 34.

I claim:

1. A fire resistant cabinet for maintaining its contents below a predetermined temperature comprising, an inner container at least partly of double-walled construction, a material located within the walls of the inner container and which undergoes a phase change requiring latent heat below the predetermined temperature; an outer casing surrounding and spaced apart from the inner container; a thermal insulation layer between the outer casing and the inner container comprising a plurality of spaced apart, low thermal emissivity, heat shields each being parallel to the adjacent wall of the outer casing; and at least six bridge members connecting the inner container and the outer casing, each bridge member being of zig-zag shape and defining a plurality of slots extending generally parallel to the crests of the zig-zag, the bridge members supporting the inner container relative to the outer casing even if the cabinet is subjected to an impact.

2. A fire resistant cabinet as claimed in claim 1 wherein the heat shields comprise metal foil coated with a low thermal emissivity coating.

3. A fire resistant cabinet as claimed in claim 1 wherein at least some heat shields parallel to a first wall of the outer casing are integral with heat shields parallel to a second wall of the outer casing.

4. A fire resistant cabinet as claimed in claim 1 wherein adjacent parallel slots are in staggered relationship.

* * * * *